US006885843B2

(12) United States Patent
Park

(10) Patent No.: US 6,885,843 B2
(45) Date of Patent: Apr. 26, 2005

(54) WET ELECTRO-PHOTOGRAPHIC PRINTER HAVING SUBSIDIARY INTERMEDIATE TRANSFER UNIT FOR IMPROVING TRANSFER EFFICIENCY

(75) Inventor: Woo-young Park, Gyunggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 7 days.

(21) Appl. No.: 10/455,816

(22) Filed: Jun. 6, 2003

(65) Prior Publication Data

US 2003/0235441 A1 Dec. 25, 2003

(30) Foreign Application Priority Data

Jun. 7, 2002 (KR) ..... 2002-32061

(51) Int. Cl.[7] ..... G03G 15/20
(52) U.S. Cl. ..... 399/307
(58) Field of Search ..... 399/307, 302, 399/308

(56) References Cited

U.S. PATENT DOCUMENTS 6,282,392 B1 * 8/2001 Yamaguchi ..... 399/237

FOREIGN PATENT DOCUMENTS

JP 11-338261 A * 12/1999 ..... G03G/15/10

* cited by examiner

*Primary Examiner*—Quana Grainger
(74) *Attorney, Agent, or Firm*—Staas & Halsey, LLP

(57) ABSTRACT

A wet electro-photographic printer includes a transfer/fixing apparatus having a subsidiary intermediate transfer unit disposed to contact a transfer belt to re-transfer an image on a printing paper after receiving the image from a transfer belt, a back-up unit disposed to contact the subsidiary intermediate transfer unit through the printing paper in order to transfer the image transferred to the subsidiary intermediate transfer unit to the printing paper, and a fixing unit fixing the image simultaneously or separately when the image transferred to the subsidiary intermediate transfer unit is re-transferred to the printing paper. The transfer belt includes a single non-elastic layer made of one material selected from polyimide, polycabonate and ethylene-tetrafluoroethylene. The subsidiary intermediate transfer unit includes a subsidiary intermediate transfer roller having an elastic layer of a predetermined thickness to which a voltage of a predetermined polarity is supplied to attach the image formed on the transfer belt to the printing paper, and contacting the transfer belt with a predetermined pressure. Accordingly, the printer having the subsidiary intermediate transfer unit can improve a transfer efficiency, such as color registration quality, and reduce manufacturing expenses as the subsidiary intermediate transfer unit having the elastic layer with the predetermined thickness, and the transfer belt having the single thin regular non-elastic layer are used so that the image formed on the transfer belt is not directly transferred to the printing paper but transferred and fixed through the subsidiary intermediate transfer unit.

18 Claims, 2 Drawing Sheets

WET ELECTRO-PHOTOGRAPHIC PRINTER HAVING SUBSIDIARY INTERMEDIATE TRANSFER UNIT FOR IMPROVING TRANSFER EFFICIENCY

CROSS-REFERENCE TO RELATED APPLICATION

This application claims the benefit of Korean Application No. 2002-32061, filed Jun. 7, 2002, in the Korean Intellectual Property Office, the disclosure of which is incorporated herein by reference.

BACKGROUND OF THE INVENTION

1. Field of the Invention

The present invention relates to a wet electro-photographic printer using a liquid developing agent, and more particularly, to a wet electro-photographic printer which transfers and/or fixes an image formed on a transfer belt to and/or on a sheet of printing paper via a subsidiary intermediate transfer unit to improve a transfer efficiency instead of transferring the image on the transfer belt directly to the printing paper.

2. Description of the Related Art

A conventional electro-photographic printer creates an image by transferring and fixing an image to and on a sheet of printing paper after forming an electrostatic latent image on a photosensitive medium, such as a photosensitive belt or a photosensitive drum, and developing the electrostatic latent image using developing agents with predetermined colors. The electro-photographic printer is divided into a wet type and a dry type according to developing agents. The wet electro-photographic printer uses a developing liquid having a volatile liquid carrier mixed with powdered toner as the developing agent. The wet electro-photographic printer using the developing liquid has a better printing quality than the dry electro-photographic printer using the powered toner. Moreover, the wet electro-photographic printer can prevent harm caused by dust generated from the powdered toner, and thus the wet electro-photographic printer has been increasingly used.

FIG. 1 schematically shows a conventional wet electro-photographic printer. The wet electro-photographic printer includes photosensitive media 9, such as OPC drums (Organic Photoconductive Drums), laser scanning units 11, charging rollers 12, developing apparatuses 13, an endless transfer belt 10, such as a photosensitive belt, moving along an endless path, first and second rollers 21 and 22 rotating the transfer belt 10 along the endless path, first transfer rollers 8 transferring an image to the transfer belt 10, a second transfer roller 23 transferring the image to a sheet of printing paper P, a fixing roller 25 fixing the image, and a cleaning blade 51 eliminating an image (developing agents 48) remaining on the transfer belt 10. The enumerated parts form a desired image on the printing paper D by performing an image forming process including charging, light exposing, developing, transferring and fixing processes in turn.

A conventional color printer, such as the conventional wet electro-photographic printer generally includes four laser scanning units 11 for color-printing, and four developing apparatuses 13 respectively containing the four developing agents 48 of black, yellow, cyan and magenta. Each of the developing apparatuses 13 has a developing roller 7 under the photosensitive mediums 9, and a container 6 storing a corresponding one of the developing agents 48.

An operation of the above wet electro-photographic printer is as follows. First of all, when a printing command is generated, an electrically charged layer, that is, an electrostatic latent image corresponding to an image to be printed, is formed on the photosensitive media 9 by the charging rollers 12 and the laser scanning units (LSU) 11. Next, an area where the electrostatic latent image is formed is coated with the developing agents 48 stored in the containers 6 of the developing apparatuses 13 due to an operation of the developing rollers 7 to form a developing agent-image (herein below, it will be just called "an image") made of toner and a liquid carrier. The image formed on the photosensitive mediums 9 by the developing apparatuses 13 is transferred from the photosensitive media 9 to the transfer belt 10 by first transfer voltage and pressure of the first transfer roller 8 placed inside of the transfer belt 10. The image that has been transferred to the transfer belt 10 is transferred to the printing paper P, which is conveyed through a nip between the transfer belt 10 and the second transfer roller 23 due to second transfer voltage and pressure of the second transfer roller 23 as the transfer belt 10 moves toward the second transfer roller 23 placed at a right side of FIG. 1, which is a side of the second roller 22, while being rotated by the first and second rollers 21 and 22.

The image that has been transferred on the printing paper P is fixed on the printing paper P by the fixing roller 25 and a back-up roller 26, thereby finally forming a desired image.

After the image transferred on the transfer belt 10 is transferred to the printing paper P, the transfer belt 10 moves toward the cleaning blade 51 installed to be in contact with an image forming area of the transfer belt 10 at a side of the first roller 21, that is, a left side of FIG. 1, while being continuously rotated by the first and second rollers 21 and 22. At this point, the developing agent remaining on a surface of the transfer belt 10 is removed from the transfer belt 10 by the cleaning blade 51 to print a next image and is collected in a carrier container 52.

The transfer belt 10 from which the remaining developing agent is removed, repeats the above operation to form and develop a new electrostatic latent image of the next image through the photosensitive media 9, the laser scanning units 11 and the developing apparatuses 13.

Yet, in the conventional printer having the above structure, the image transferred to the transfer belt 10 is directly transferred to the printing paper P by the second transfer roller 23, thus a transfer belt 10 having an elastic layer, such as elastic gum, should be used to transfer the image to the printing paper P having a coarse surface.

Therefore, to prevent the transfer belt 10 from being slacked due to elasticity of the elastic layer, an additional non-elastic layer preventing the elasticity of the elastic layer is formed by coating or attaching on or to the elastic layer. As a result, manufacturing expenses are increased as an additional process is added. Deflection (variation) of a thickness of the elastic layer is generated as the transfer belt 10 becomes thicker, and thus it is difficult to arrange registration of each color.

In addition, since the second transfer roller 23 transfers the image from the transfer belt 10 to the printing paper P using an adequate voltage, for example: DC−2.4 K V, supplied to the printing paper P, the transfer belt 10 should have a thickness from 480 to 680 $\mu$m. Therefore, under the above transfer voltage condition, when the transfer belt 10 becomes thicker, an efficiency of the second transfer roller 23 is degraded.

Furthermore, since the elastic layer of the transfer belt 10 is made of a material having elasticity, such as the elastic gum, if the cleaning blade 51 made of a flexible material, such as urethane, and installed at a side of the first roller 21, is operated for a long time while being in close contact with the elastic layer of the transfer belt 10 to remove the developing agent remaining on the surface of the transfer belt 10 after the image is transferred on the printing paper P, then the cleaning blade 51 may cause friction with the elastic layer of the transfer belt 10 so that the cleaning blade 51 is not firmly fixed and caught in the transfer belt 10, or the image forming surface of the transfer belt 10 is damaged.

In a case that the transfer belt 10 is damaged as described above, the image finally formed on the printing paper P is stained with stripes, and noise and vibration are generated for a subsequent cleaning process. Especially, in a case that the vibration is generated to the transfer belt 10, a toner image formed during developing and transferring processes has an additional image of abnormal stripes, such as a jitter, and thus quality of a finally formed image is degraded.

Furthermore, since the conventional printer has the second transfer roller 23 transferring the image from the transfer belt 10 to the printing paper P, which is separated from the fixing apparatuses 25 and 26 fixing the image on the printing paper P through heat and pressure, there is a great possibility of breaking down due to an increase of parts transferring and fixing the image to and/or from the printing paper. Accordingly, reliability of the printer is decreased, and manufacturing expenses increases.

SUMMARY OF THE INVENTION

The present invention has been made to overcome the above and/or other problems of the related art. Accordingly, it is an aspect of the present invention to provide a printer having a subsidiary intermediate transfer unit that can improve an transfer efficiency, such as color registration quality, and reduce manufacturing expenses by using a transfer belt having a single thin regular non-elastic layer and a subsidiary intermediate transfer unit having an elastic layer with a predetermined thickness so that an image formed on the transfer belt is not directly transferred to a sheet of printing paper but transferred and fixed through the subsidiary intermediate transfer unit.

Another aspect of the present invention is to provide a printer that can prevent an image forming surface of a transfer belt from being damaged due to a friction of a cleaning blade and the transfer belt and also to prevent a quality of an image from deteriorating during cleaning the transfer belt and can increase a life span of the cleaning blade using the transfer belt made of a material different from the cleaning blade.

Another aspect of the present invention is to provide a printer to reduce manufacturing expenses and increase reliability of the printer by reducing a breakdown possibility of the parts generated as a result of the increased number of parts required for transferring and fixing an image by applying heat and pressure using a fixing apparatus integrally formed with a subsidiary intermediate transfer unit.

Additional aspects and advantages of the invention will be set forth in part in the description which follows and, in part, will be obvious from the description, or may be learned by practice of the invention.

A wet electro-photographic printer having a subsidiary intermediate transfer unit improving a transfer efficiency according to the above and/or other aspects of the present invention includes a transfer belt having an image forming surface, an image forming device forming an image on the image forming surface of the transfer belt with a developing agent by using an electro-photographic method in accordance with an image signal, a transfer belt cleaning apparatus removing a developing agent and foreign substances remaining on the transfer belt after the image formed on the transfer belt is transferred to a sheet of printing paper, and a transfer/fixing apparatus having a subsidiary intermediate transfer unit disposed to contact the transfer belt to re-transfer the image to the printing paper after receiving the image from the transfer belt, a back-up unit disposed to contact the subsidiary intermediate transfer unit through the printing paper in order to transfer the image transferred to the subsidiary intermediate transfer unit to the printing paper, and a fixing unit fixing the image at the same time when the image transferred to the subsidiary intermediate transfer unit is re-transferred to the printing paper.

The transfer belt includes a single non-elastic layer made of one material selected from polyimide, polycabonate and ethylene-tetrafluoroethylene.

The subsidiary intermediate transfer unit includes a subsidiary intermediate transfer roller having an elastic layer of a predetermined thickness, to which a voltage of a predetermined polarity is supplied, to receive the image from the transfer belt and contacting the transfer belt with a predetermined pressure. The back-up unit includes a transfer back-up roller supplying another voltage of another predetermined polarity and another pressure to the printing paper in order to transfer the image, which has been transferred to the subsidiary intermediate transfer roller, to the printing paper.

The fixing unit includes a heater disposed at least one of the subsidiary intermediate transfer roller and the transfer back-up roller to supply heat to the printing paper passing between the subsidiary intermediate transfer roller and the transfer back-up roller so that the image transferred to the printing paper through the subsidiary intermediate transfer roller is fixed on the printing paper.

The transfer belt cleaning apparatus includes a blade made of urethane and disposed to contact the image forming surface of the transfer belt.

A wet electro-photographic printer having a subsidiary intermediate transfer unit for improving transfer efficiency according to the above and/or other aspects of the present invention includes a transfer belt having an image forming surface, an image forming device forming an image on the image forming surface of the transfer belt with a developing agent by using an electro-photographic method in accordance with an image signal, a transfer apparatus transferring the image formed on the transfer belt to a sheet of printing paper, a fixing apparatus fixing the image transferred to the printing paper, and a transfer belt cleaning apparatus removing the developing agent and foreign substances remaining on the transfer belt after the image formed on the transfer belt is transferred to the printing paper. The transfer apparatus includes a subsidiary intermediate transfer unit disposed to contact the transfer belt to re-transfer the image to the printing paper after receiving the image from the transfer belt, and a back-up unit disposed to contact the subsidiary intermediate transfer unit through the printing paper in order to transfer the image transferred to the subsidiary intermediate transfer unit to the printing paper.

The transfer belt includes a single non-elastic layer made of one material selected from polyimide, polycabonate and ethylene-tetrafluoroethylene.

The subsidiary intermediate transfer unit includes a subsidiary intermediate transfer roller having an elastic layer of a predetermined thickness, supplied with a voltage of a predetermined polarity to receive the image from the transfer belt, and contacting the transfer belt with a predetermined pressure, and a transfer back-up roller supplying another voltage of another predetermined polarity and another pressure to the printing paper to transfer the image, which has been transferred to the subsidiary intermediate transfer roller, to the printing paper.

The fixing apparatus includes a fixing roller supplying heat to the printing paper and a fixing back-up roller supplying the pressure to the printing paper.

The transfer belt cleaning apparatus includes a blade made of urethane and disposed to contact the image forming surface of the transfer belt.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
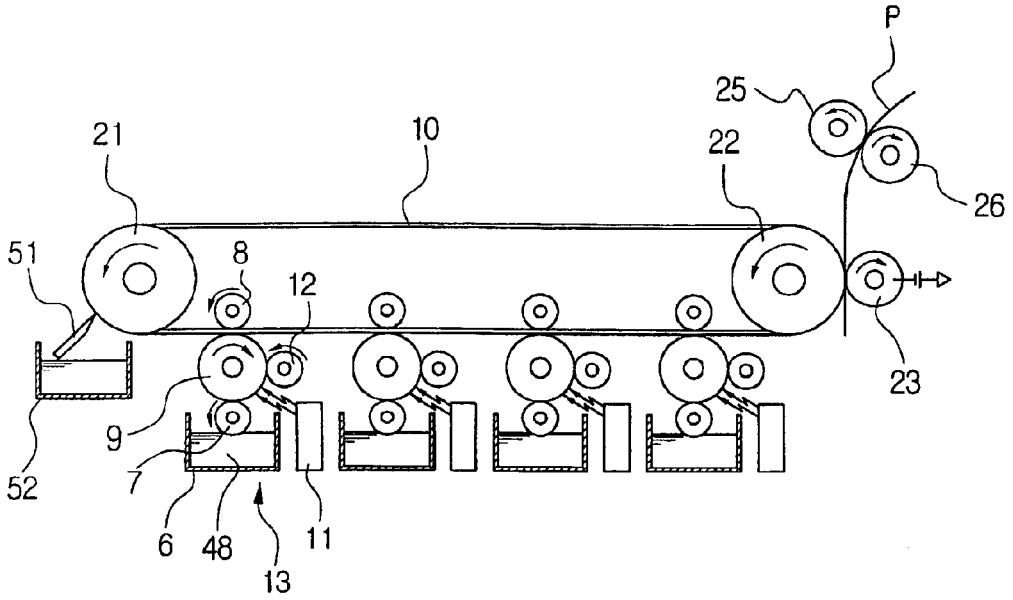
FIG. 1 (PRIOR ART)
FIG. 1 is a schematic view showing a conventional wet electro-photographic printer.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Hereinbelow, a wet electro-photographic printer having a subsidiary intermediate transfer unit improving a transfer efficiency according to preferred embodiments of the present invention will be described in greater detail by referring to the appended drawings.

Figure 2:
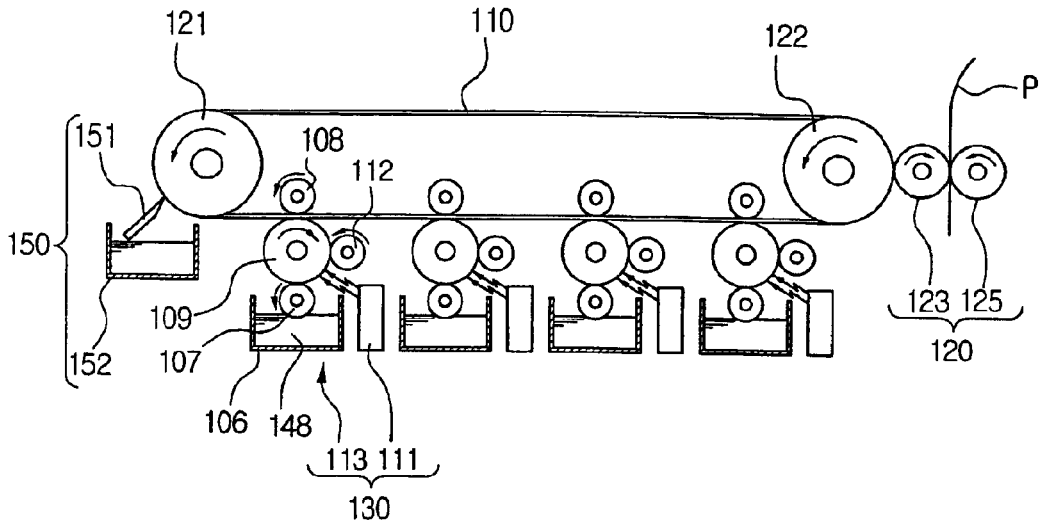
FIG. 2 is a schematic view showing a wet electro-photographic printer having a subsidiary intermediate transfer unit improving a transfer efficiency according to an embodiment of the present invention.

FIG. 2 is a schematic view showing the wet electro-photographic color printer having the subsidiary intermediate transfer unit improving the transfer efficiency according to an embodiment of the present invention.

The wet electro-photographic color printer includes a transfer belt 110, such as a photosensitive belt, rotated along an endless path by first and a second rollers 121 and 122, image forming devices 109, 130 and 108 forming an image developed by a developing agent on the transfer belt 110 by using an electro-photographic method, a transfer/fixing apparatus 120 transferring and fixing the image formed on the transfer belt 110 to a sheet of printing paper P, and a transfer belt cleaning unit 150 cleaning a foreign substance, such as waste of the developing agent or scraps of paper, remaining on the transfer belt 110 to form a next image after the image formed on the transfer belt 110 has been transferred to the printing paper P.

The transfer belt 110 is disposed horizontally by the first and second rollers 121 and 122 spaced-apart from each other by a predetermined distance and is formed to have a single non-elastic layer made of one of polyimide, PC, and ETFE. Therefore, a thickness of the transfer belt 110 is decreased, and manufacturing expenses are also decreased.

The image forming devices 109, 130 and 108 for forming the image on the transfer belt 110 includes photosensitive mediums 109, such as an OPC drum, disposed at a lower outer side of the transfer belt 110 which provides an image forming surface, image forming units 130 disposed under the photosensitive mediums 109 to form the image by attaching a developing agent 148 to the photosensitive mediums 109 using the an electro-photographic method, and a transfer unit 108 disposed inside the transfer belt 110 and opposite to the lower outer side of the transfer belt 110 at which the image forming units 130 are disposed, to transfer the image formed on the photosensitive mediums 109 to the transfer belt 110. Generally, the developing agent 148 includes of toner and a liquid carrier. Therefore, the image formed on the transfer belt 110 also has toner and liquid carrier elements.

Each of the image forming units 130 includes an LSU 111 forming an electrostatic latent image corresponding to the image to be printed on the photosensitive mediums 109 charged by a charging roller 112 in accordance with an image signal, and a developing apparatus 113 forming the image by attaching the developing agent 148 to an area of the photosensitive mediums 109 on which the electrostatic latent image is formed.

In a case of a color printer, the image forming units 130 have four LSUs 111 performing color printing, and four developing apparatuses 113 developing the electrostatic latent image with the developing agent 148 of four colors, such as black, yellow, cyan and magenta. Each of the developing apparatuses 113 has a developing roller 107, which is disposed under the photosensitive medium 109, attaching the developing agent 148 to the electrostatic latent image formed on the photosensitive medium 109, and a container 106 storing the developing agent 148.

The transfer unit 108 includes four transfer rollers transferring the image formed on the photosensitive media 109 to the transfer belt 110. The transfer rollers transfer the image formed on the photosensitive media 109 to the transfer belt 110 when high transfer voltage and pressure are supplied to the photosensitive mediums 109 and the transfer belt 110.

Alternatively, the image forming device for forming the image on the transfer belt 110 may use only the LSU IV and the developing apparatus 113 instead of using the photosensitive media 109 and the transfer rollers 108, to form the electrostatic latent image directly on the transfer belt 110 and then to attach the developing agent 140 thereto, thereby forming the image.

The transfer/fixing apparatus 120 transferring and fixing the image on the printing paper P includes a subsidiary intermediate transfer roller 123 installed to contact the transfer belt 110 at one side of the transfer belt 110, that is a right side of FIG. 2 with respect to the printing paper P, inside which the second roller 122 is disposed, and a transfer back-up roller 125 disposed to contact the subsidiary intermediate transfer roller 123.

The subsidiary intermediate roller 123 is connected to a corresponding power source (not shown) of a printed circuit board to be charged with a first voltage which is an opposite polarity to that of the image charged with a second voltage and formed on the transfer belt 110 so as to attach the image to the printing paper P. Moreover, the transfer back-up roller 125 is connected to the corresponding power source (not shown) of the printed circuit board to be charged with a third voltage which is the opposite polarity, to that of the image so as to attach the image to the printing paper P.

The subsidiary intermediate transfer roller 123 is formed as a roller having a conductive elastic layer that is thick enough to increase a transfer efficiency of transferring the image to the printing paper P with a surface roughness, for example, from 10 to 25 $\mu$m. When the first voltage of the subsidiary intermediate transfer roller 123 is adjusted to an adequate voltage, a thickness of the subsidiary intermediate transfer roller 123 can be increased to upgrade the transfer efficiency, which is different from a conventional printer limiting the thickness of the transfer belt 10 to supply a voltage to a second transfer roller 23 shown in FIG. 1.

The conductive elastic layer of the subsidiary intermediate transfer roller 123 can be formed by adding conductive materials, such as metal powder or carbon black, to a general elastic material, such as natural/synthetic gum or resin.

In addition, the transfer/fixing apparatus 120 includes a fixing unit supplying heat to fix the image on the printing paper P at the same time when the image transferred to the subsidiary intermediate transfer roller 123 from the transfer belt 110 is transferred on the printing paper P. The fixing unit includes heaters (not shown) respectively installed at the subsidiary intermediate transfer roller 123 and the transfer back-up roller 125.

Therefore, when the subsidiary intermediate transfer roller 123 and the transfer back-up roller 125 transfer the image on the printing paper P, the image is fixed on the printing paper P at the time of transferring the image from the transfer belt 110 to the printing paper P. As a result, not only deterioration of a registration quality of each color, which is generated when the transfer belt with the elastic layer is used in a conventional printer, but also unreliability of the printer and manufacturing expenses, are reduced.

The transfer belt cleaning unit 150 has a cleaning blade 151 disposed to contact the image forming surface of the transfer belt 110 at the other side of the transfer belt 110, that is, a left side of FIG. 2, on which the first roller 121 and a collector 152 collecting the developing agent 148 removed from the transfer belt 110 by the cleaning blade 151 are disposed.

The cleaning blade 151 is made of a flexible material of synthetic resin, such as natural/synthetic gum or urethane, different from materials used for making the transfer belt 110. Accordingly, the cleaning blade 151 prevents problems generated in the conventional printer, such as damaging the image forming surface of the transfer belt due to the friction with the transfer belt made of the same material with the cleaning blade, or being caught into the transfer belt while cleaning the transfer belt.

Hereinbelow, an operation of the wet electro-photographic color printer having the subsidiary intermediate transfer roller 123 improving the transfer efficiency according to the embodiment of the present invention will be described by referring to FIG. 2.

First of all, when a printing command is inputted, the electrostatic latent image corresponding to the image to be printed is formed on the photosensitive mediums 109 by the charging rollers 112 and the LSUs 111. The developing agent 148 stored in the container 106 of the developing apparatuses 113 is attached to the electrostatic latent image due to an operation of the developing rollers 107. As a result, the image having the predetermined polarity, for example, a positive polarity, is formed on the area on which the electrostatic latent image is formed.

The image of the positive polarity formed on the photosensitive mediums 109 by the developing apparatuses 113 is transferred to the transfer belt 110 by a negative transfer voltage and the pressure of the first transfer rollers 108 disposed at the lower inside of the transfer belt 110.

Then, the positive polarity image transferred to the transfer belt 10 moves to the subsidiary intermediate transfer roller 123 as the transfer belt 110 rotates, and is transferred to the subsidiary intermediate transfer roller 123 by the negative transfer voltage and the pressure from the elastic layer of the subsidiary intermediate transfer roller 123. At this time, the image is moved to the subsidiary intermediate transfer roller 123 and attached thereonto by conformability due to electrostatic force and pressure.

The positive polarity image that has been transferred to the subsidiary intermediate transfer roller 123 is transferred to the printing paper P provided from the subsidiary intermediate transfer roller 123 through the subsidiary intermediate transfer roller 123 and the transfer back-up roller 125 by the transfer back-up roller 125 supplying a high transfer voltage of the negative polarity and the pressure to the printing paper P again as the subsidiary intermediate transfer roller 123 is rotated. At this time, the printing paper P has the negative polarity due to the transfer back-up roller 125 to which the negative polarity voltage is supplied, thus drawing and attaching the positive polarity image to the printing paper P.

Moreover, as the subsidiary intermediate transfer roller 123 and the transfer back-up roller 125 are connected to a heater to apply the heat of a high temperature to the printing paper P, the image is fixed on the printing paper P at the same time when it is transferred thereon, and as a result, a finally desired image is formed.

After the image is transferred to and fixed on the printing paper P, the transfer belt 110 is continuously moved in a direction indicated by arrows in FIG. 2 by the first and second rollers 121 and 122.

When an area of the transfer belt 110 having the image transferred to the printing paper P moves to pass through a place where the cleaning blade 151 is installed, at the other side of the transfer belt 110, that is, at the right side in FIG. 2, the cleaning blade 151 cleans the image forming surface of the transfer belt 110, and accordingly, the remaining developing agent 148 is collected from the image forming surface of the transfer belt 110 to the collector 152.

At this time, the cleaning blade 151 is made of some materials which are different from the transfer belt 110 and a natural/synthetic gum or resin, such as urethane, and thus the remaining developing agent 148 can be easily removed without causing the problems, such as damaging the image forming surface due to the friction with the transfer belt 110 or being caught into the transfer belt 110.

The transfer belt 110 that has passed through the cleaning blade 151 repeats the above described processes to form and develop another electrostatic latent image to be printed next through the photosensitive mediums 109, the LSUs 111 and the developing apparatuses 113.

Figure 3:
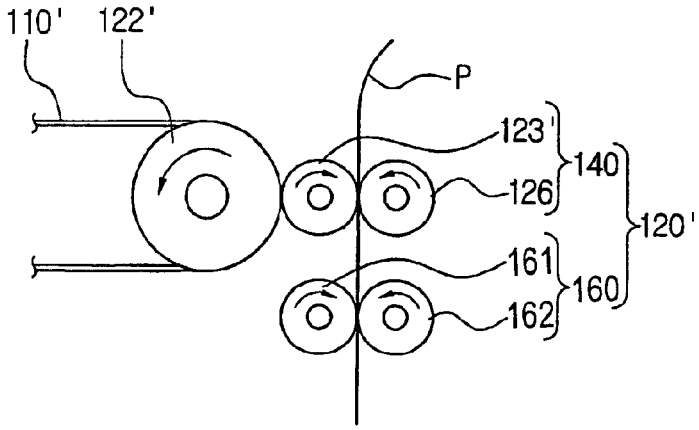
FIG. 3 is a schematic view showing a wet electro-photographic printer having a subsidiary intermediate transfer unit improving a transfer efficiency according to another embodiment of the present invention.

Referring to FIG. 3, the wet electro-photographic color printer having another subsidiary intermediate transfer unit according to another embodiment of the present invention will be described hereinbelow.

The color printer according to this embodiment of the present invention has the same structure with the embodiment shown in FIG. 2 except having a transfer/fixing apparatus 120' having a subsidiary intermediate transfer unit 140 and a fixing unit 160.

The subsidiary intermediate transfer unit 140 has a subsidiary intermediate transfer roller 123' disposed to contact a transfer belt 110' with a certain pressure, and a transfer back-up roller 126 contacting the subsidiary intermediate transfer roller 123' with the certain pressure.

The subsidiary intermediate transfer roller 123' has a conductive elastic layer like the subsidiary intermediate transfer roller 123 of FIG. 2 to improve the transfer efficiency of the image which is transferred to the printing paper P having a coarse surface, and is connected to the power source (not shown) of the printed circuit board to receive power having a predetermined polarity and an electrical potential so as to attach the image formed on the transfer belt 110' to the printing paper P.

The transfer back-up roller 126 is disposed to apply the certain pressure to the subsidiary intermediate transfer roller 123', and connected to the power source (not shown) of the printed circuit board in order to supply the predetermined polarity and the voltage of the predetermined electrical potential to the printing paper P.

The fixing unit 160 includes a fixing roller 161 having a heater (not shown) applying heat to fix the image transferred through the subsidiary intermediate transfer roller 123' of the subsidiary intermediate transfer unit 140 and the transfer back-up roller 126 to the printing paper P, and a fixing back-up roller 162 pressing the printing paper P to the fixing roller 161 with the predetermined pressure. At this time, the fixing back-up roller 162 generally does not have a heater, but may include one to apply the heat to the printing paper P to improve a fixing efficiency.

In this embodiment of the present invention, the fixing unit 160 is separated from the subsidiary intermediate transfer unit 140, thus there is less advantage in reducing the number of parts required for transferring and fixing the image, but the subsidiary intermediate transfer roller 123' having the elastic layer of the predetermined thickness and a transfer belt having a single thin regular non-elastic layer like in the embodiment shown in FIG. 2 are used so that the transfer efficiency and a transfer belt cleaning efficiency can be improved.

Hereinbelow, the operation of the wet electro-photographic color printer having the subsidiary intermediate transfer unit 140 improving the transfer efficiency according to this embodiment of the present invention will be described by referring to FIG. 3.

When a positive polarity image formed on the transfer belt 110' reaches a nip between the transfer belt 110' and the subsidiary intermediate transfer roller 123', the image on the transfer belt 110' is transferred to the subsidiary intermediate transfer roller 123' by the electrical voltage of the negative polarity and a contact pressure applied to the elastic layer of the subsidiary intermediate transfer roller 123'.

After the image is transferred from the transfer belt 110' to the subsidiary intermediate transfer roller 123', the positive polarity image is transferred to the printing paper P at the nip between the subsidiary intermediate transfer roller 123' and the transfer back-up roller 126 by the transfer back-up roller 126 applying a regular pressure and the negative electric voltage to the printing paper P, as the subsidiary intermediate transfer roller 123' is continuously rotated.

The image transferred to the printing paper P is formed as a final printing image by being fixed on the printing paper P due to the heat and the pressure of the fixing roller 161 and the fixing back-up roller 162 of the fixing unit 160 as the image moves to the fixing unit 160 by the subsidiary intermediate transfer roller 123' and the transfer back-up roller 126.

The transfer belt 110' is cleaned by the cleaning blade 151 of the different material with the transfer belt 110' like in the embodiment of FIG. 2 after the image is transferred to the subsidiary intermediate transfer roller 123'.

As described so far, the printer having the subsidiary intermediate transfer unit of the present invention can improve the transfer efficiency, such as a color registration quality, and reduce the manufacturing expenses, as the transfer belt having the single thin regular non-elastic layer and the subsidiary intermediate transfer unit having the elastic layer with the predetermined thickness are used so that the image formed on the transfer belt is not directly transferred to the printing paper but transferred and fixed through the subsidiary intermediate transfer unit.

In addition, as the transfer belt is made of a material different from the transfer belt cleaning blade, the printer of the present invention can prevent the image forming surface of the transfer belt from being damaged due to the friction between the cleaning blade and the transfer belt while cleaning the transfer belt. Also, the quality of the image can be prevented from deteriorating, and the cleaning blade can be used longer.

Furthermore, in the printer of the present invention, when the fixing apparatus fixing the image by applying the heat and the pressure is integrally formed with the subsidiary intermediate transfer roller, the number of parts required for transferring and fixing the image is reduced, thus the reliability of the product can be increased as the breakdown possibility of the parts is low, and the manufacturing expenses are decreased.

Although embodiments of the present invention have been described, it will be understood by those skilled in the art that the present invention should not be limited to the described preferred embodiments, but various changes and modifications can be made within the spirit and the scope of the present invention. Accordingly, the scope of the present invention is not limited within the described range but is defined in the following claims and their equivalents.

What is claimed is:

1. A wet electro-photographic printer improving a transfer efficiency, comprising:

a transfer belt having an image forming surface and a single non-elastic layer;

an image forming device forming an image on the image forming surface of the transfer belt by using a developing agent by an electro-photographic method in accordance with an image signal;

a transfer belt cleaning apparatus removing the developing agent and foreign substances remaining on the transfer belt after the image formed on the transfer belt is transferred to a printing paper; and a transfer/fixing apparatus comprising:

a subsidiary intermediate transfer unit having a subsidiary intermediate transfer roller formed of an elastic layer of a predetermined thickness disposed to contact the transfer belt to re-transfer the image to the printing paper after receiving the image from the transfer belt, a back-up unit disposed to contact the subsidiary intermediate transfer unit through the printing paper to transfer the image transferred to the subsidiary intermediate transfer unit to the printing paper, and a fixing unit simultaneously fixing the image when the image transferred to the subsidiary intermediate transfer unit is re-transferred to the printing paper.

2. The wet electro-photographic printer of claim 1, wherein the transfer belt comprises:

the single non-elastic layer made of one material selected from polyimide, polycabonate and ethylene-tetrafluoroethylene.

3. The wet electro-photographic printer of claim 2, wherein the subsidiary intermediate transfer roller to which a voltage of a predetermined polarity is supplied to attach the image formed on the transfer belt to the printing paper, and contacts the transfer belt with a predetermined pressure.

4. The wet electro-photographic printer of claim 3, wherein the back-up unit comprises a transfer back-up roller supplying a voltage of a predetermined polarity and a pressure to the printing paper to transfer the image, which has been transferred to the subsidiary intermediate transfer roller, to the printing paper.

5. The wet electro-photographic printer of claim 4, wherein the fixing unit comprises:

a heater disposed at least one of the subsidiary intermediate transfer roller and the transfer back-up roller to apply heat to the printing paper passing through the subsidiary intermediate transfer roller and the transfer back-up roller so that the image transferred to the printing paper through the subsidiary intermediate transfer roller is fixed on the printing paper.

6. The wet electro-photographic printer of claim 5, wherein the transfer belt cleaning apparatus comprises:

a blade made of urethane and disposed to contact the image forming surface of the transfer belt.

7. A wet electro-photographic printer improving a transfer efficiency of an image, comprising:

a transfer belt having a single non-elastic layer and an image forming surface;

an image forming device forming the image on the image forming surface of the transfer belt by using a developing agent by an electro-photographic method in accordance with an image signal;

a transfer apparatus transferring the image formed on the transfer belt to a printing paper;

a fixing apparatus fixing the image transferred to the printing paper; and a transfer belt cleaning apparatus removing the developing agent and foreign substances remaining on the transfer belt after the image formed on the transfer belt is transferred to the printing paper, wherein the transfer apparatus comprises:

a subsidiary intermediate transfer unit having a subsidiary intermediate transfer roller formed of an elastic layer of a predetermined thickness contacting the transfer belt to re-transfer the image to the printing paper after receiving the image from the transfer belt, and a back-up unit contacting the subsidiary intermediate transfer unit through the printing paper.

8. The wet electro-photographic printer of claim 7, wherein the single non-elastic layer is made of one material selected from polyimide, polycabonate and ethylene-tetrafluoroethylene.

9. The wet electro-photographic printer of claim 8, wherein the subsidiary intermediate transfer unit comprises:

the subsidiary intermediate transfer roller to which a voltage of a first polarity is supplied to attach the image formed on the transfer belt to the printing paper, and contacting the transfer belt with a first pressure; and a transfer back-up roller supplying a second voltage of a second polarity and a second pressure to the printing paper to transfer the image, which has been transferred to the subsidiary intermediate transfer roller, to the printing paper.

10. The wet electro-photographic printer of claim 9, wherein the fixing apparatus comprises:

a fixing roller applying heat; and a fixing back-up roller supplying a third pressure to the printing paper.

11. The wet electro-photographic printer of claim 10, wherein the transfer belt cleaning apparatus comprises:

a blade made of urethane and disposed to contact the image forming surface of the transfer belt.

12. An electra-photographic printer improving a transfer efficiency of an image to be formed on a sheet of printing paper, comprising:

a transfer belt having an image forming surface formed with the image; and a transfer apparatus disposed between the image forming surface of the transfer belt and the printing paper so as to transfer the image from the transfer belt to the printing paper through the transfer apparatus, wherein the transfer apparatus comprises a transfer roller and a fixing roller spaced apart from the transfer roller.

13. The electro-photographic printer of claim 12, further comprising:

an image forming device forming the image on the image forming surface of the transfer belt with a developing agent by an electro-photographic method in accordance with an image signal.

14. The electro-photographic printer of claim 12, further comprising:

a transfer belt cleaning apparatus made of urethane to remove the developing agent and foreign substances remaining on the transfer belt after the image formed on the transfer belt has been transferred to the printing paper.

15. The electro-photographic printer of claim 12, wherein the transfer roller contacts both the printing paper and the image forming surface of the transfer belt to transfer the image from the transfer belt to the printing paper.

16. The electro-photographic printer of claim 12, wherein the fixing roller fixes the image transferred from the transfer apparatus to the printing paper.

17. The electro-photographic printer of claim 12, wherein the image is not directly transferred to the printing paper from the transfer belt.

18. A method of improving a transfer efficiency of an image to be formed on a sheet of printing paper in an electro-photographic printer, the method comprising:

forming the image on an image forming surface of a transfer belt; and causing a transfer apparatus to be disposed between the image forming surface of the transfer belt and the printing paper;

transferring the image from the transfer belt to a transfer roller of the transfer apparatus;

retransferring the image from the transfer roller to the printing paper; and fixing the image to the printed paper with a fixing roller of the transfer apparatus which is spaced apart from the transfer roller, after the retransferring.

* * * * *

UNITED STATES PATENT AND TRADEMARK OFFICE

CERTIFICATE OF CORRECTION

PATENT NO. : 6,885,843 B2
DATED : April 26, 2005
INVENTOR(S) : Woo-young Park

It is certified that error appears in the above-identified patent and that said Letters Patent is hereby corrected as shown below:

Column 12,
Line 13, change “electra” to -- electro --.

Signed and Sealed this

Third Day of January, 2006

JON W. DUDAS
*Director of the United States Patent and Trademark Office*